US010305177B2

(12) United States Patent
Kobayashi

(10) Patent No.: US 10,305,177 B2
(45) Date of Patent: May 28, 2019

(54) VEHICLE-MOUNTED ANTENNA WATERPROOF STRUCTURE

(71) Applicant: HARADA INDUSTRY CO., LTD., Tokyo (JP)

(72) Inventor: Hidekazu Kobayashi, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 806 days.

(21) Appl. No.: 14/771,564

(22) PCT Filed: Mar. 7, 2014

(86) PCT No.: PCT/JP2014/056042
§ 371 (c)(1),
(2) Date: Aug. 31, 2015

(87) PCT Pub. No.: WO2014/136960
PCT Pub. Date: Sep. 12, 2014

(65) Prior Publication Data

US 2016/0020507 A1 Jan. 21, 2016

(30) Foreign Application Priority Data

Mar. 8, 2013 (JP) ..... 2013-047331

(51) Int. Cl.

| | |
|---|---|
| ***H01Q 1/42*** | (2006.01) |
| ***H01Q 1/48*** | (2006.01) |
| ***H01Q 1/32*** | (2006.01) |
| *H01Q 1/36* | (2006.01) |
| *H01Q 1/12* | (2006.01) |

(52) U.S. Cl.
CPC ..... *H01Q 1/3275* (2013.01); *H01Q 1/42* (2013.01); *H01Q 1/1214* (2013.01); *H01Q 1/362* (2013.01); *H01Q 1/48* (2013.01)

(58) Field of Classification Search
CPC ..... H01Q 1/42; H01Q 1/3275; H01Q 1/48; H01Q 1/362; H01Q 1/1214; H01Q 1/40
See application file for complete search history.

(56) References Cited

FOREIGN PATENT DOCUMENTS

| | | | |
|---|---|---|---|
| JP | 2008-182663 | A | 8/2008 |
| JP | 2012-127903 | A | 7/2012 |
| JP | 2012-204996 | A | 10/2012 |
| JP | 2013-5127 | A | 1/2013 |

OTHER PUBLICATIONS

International Search Report dated May 20, 2014, issued in counterpart International Application No. PCT/JP2014/056042 (1 page).

*Primary Examiner* — Phi D A
(74) *Attorney, Agent, or Firm* — Westerman, Hattori, Daniels & Adrian, LLP

(57) ABSTRACT

Provided is an on-board antenna waterproof structure that eliminates the need for assembling a waterproof structure by manual work, thus preventing an attachment error, and in which waterproof resin is strongly fused to a resin base. A waterproof structure applied in an on-board antenna installed on an antenna installment surface comprises a resin base (10) made of resin, and a flexible, antenna installed-side waterproof resin portion (20). The resin base (10) has one surface facing the antenna installment surface and the other surface being covered by an antenna cover (3) defining an outer shape of the on-board antenna. The antenna installed-side waterproof resin portion (20) abuts the antenna installment surface.

3 Claims, 4 Drawing Sheets

VEHICLE-MOUNTED ANTENNA WATERPROOF STRUCTURE

TECHNICAL FIELD

The present invention relates to a waterproof structure provided in a vehicle-mounted antenna that is mounted on an antenna mounting surface, and particularly to a vehicle-mounted antenna waterproof structure that is provided on a resin base.

BACKGROUND ART

In general, a vehicle-mounted antenna uses conductive material as its base. The material is used as the ground of the antenna, and the material is fixed to a vehicle roof or the like to secure the earth for a vehicle body. In order to make a portion between the conductive base and the vehicle's antenna mounting surface waterproof, a flexible base pad that is made of resin is provided in such a way as to cover an antenna mounting surface-side surface of the conductive base and be fitted onto the conductive base.

In recent years, the weight of such vehicles as electric vehicles and hybrid cars has been reduced in view of fuel economy. The weight of vehicle-mounted antennas is also required to be reduced, and development of a vehicle-mounted antenna with a resin base is underway instead of the vehicle-mounted antenna with the conductive base. For example, Patent Document 1 discloses an antenna base that is made by combining a resin base and a conductive base. On a lower surface of the resin base, around a boss portion, an annular groove is provided, and a ring-shaped seal is fitted. Moreover, a string-like gap cover having a groove portion is wound around a peripheral side surface of the resin base, and the peripheral side surface of the resin base is fitted into the groove portion of the gap cover.

PRIOR ART DOCUMENT

Patent Document

[Patent Document 1] International Publication No. 2012/127903

SUMMARY OF THE INVENTION

Problems to be Solved by the Invention

In the case of the vehicle-mounted antenna with the conductive base, the base pad that is made of resin is fixed in such a way as to be fitted onto the conductive base. Therefore, the antenna needs to be assembled manually, and a lot of time and effort is required. Moreover, the base pad may not be evenly fitted onto the conductive base, resulting in a change in the thickness of the base pad; a pressing force between the vehicle's antenna mounting surface and the base pad could become uneven. As the weight of vehicles has been reduced in recent years, the steel plate of the vehicle roof is becoming thin and lower in strength. Therefore, it is becoming difficult to evenly make the gap waterproof by pressing the base pad against the vehicle roof with strong force.

In the case of Patent Document 1, the structure of the gap cover being fitted onto the resin base is not different from the base pad being fitted onto the conductive base. Therefore, the assembling work requires a lot of time and effort, and the pressing force between the vehicle's antenna mounting surface and the base pad is not uniform. In this manner, the structure is not different from that of the conductive base. Furthermore, in the annular groove around the boss portion of the lower surface of the base, the ring-shaped seal is fitted. However, the designed waterproof performance might not be fully demonstrated due to production error, positional deviation, and the like.

In view of the above circumstances, the present invention is intended to provide a vehicle-mounted antenna waterproof structure that does not require work to manually assemble a waterproof structure and can prevent a mistake in mounting and includes waterproof resin that is tightly welded to the resin base.

Means for Solving the Problems

To achieve the above-mentioned object of the present invention, a vehicle-mounted antenna waterproof structure of the present invention may include: a resin base that is made of resin and whose one surface faces an antenna mounting surface while the other surface is covered with an antenna cover that defines an outer shape of the vehicle-mounted antenna; and an antenna mounting-side waterproof resin portion having flexibility that is welded to the resin base and abuts on the antenna mounting surface.

In this case, the resin base may include a hole portion to secure conduction into an inside of the antenna cover; and the antenna mounting-side waterproof resin portion may also be welded to a peripheral portion of the hole portion.

A vehicle-mounted antenna waterproof structure of the present invention may include: a resin base that is made of resin and includes a hole portion to secure conduction into an inside of an antenna cover and whose one surface faces an antenna mounting surface while the other surface is covered with the antenna cover that defines an outer shape of the vehicle-mounted antenna; and an antenna mounting-side waterproof resin portion having flexibility that is welded to a peripheral portion of the hole portion of the resin base and abuts on the antenna mounting surface.

The antenna mounting-side waterproof resin portion may also be welded to a peripheral portion of the resin base.

The vehicle-mounted antenna waterproof structure may further include a cover-side waterproof resin portion having flexibility that is welded to a surface of the resin base covered with the antenna cover and on which the antenna cover abuts.

A vehicle-mounted antenna waterproof structure of the present invention may include: a resin base that is made of resin and whose one surface faces an antenna mounting surface while the other surface is covered with an antenna cover that defines an outer shape of the vehicle-mounted antenna; and a cover-side waterproof resin portion having flexibility that is welded to a surface of the resin base covered with the antenna cover and on which the antenna cover abuts.

In this case, the cover-side waterproof resin portion may also be provided at a position on which a vehicle-mounted antenna circuit board placed in an inner portion covered with the antenna cover abuts.

The resin base may further include a plurality of tunnel portions that pass through portions near where the cover-side waterproof resin portion and the antenna mounting-side waterproof resin portion are welded; and the cover-side waterproof resin portion and the antenna mounting-side waterproof resin portion may be connected via the tunnel portions.

The tunnel portions may be disposed in such a way as to avoid a position on which the antenna cover abuts.

The cover-side waterproof resin portion and the antenna mounting-side waterproof resin portion may be connected via a side resin portion that is welded to a side surface of the resin base.

The resin base may further include a reinforcing rib near a peripheral portion of the resin base; and the reinforcing rib may be positioned near one side of the cover-side waterproof resin portion and/or one side of the antenna mounting-side waterproof resin portion.

The resin base may further include an a asperity portion at a position where the antenna mounting-side waterproof resin portion is welded, in order to increase a welding surface.

The vehicle-mounted antenna waterproof structure may further include: in the case where the antenna cover defining the outer shape of the vehicle-mounted antenna includes an inner cover covering the resin base and an outer cover covering the inner cover, an inner cover-side waterproof resin portion having flexibility that is welded to the inner cover and abuts on the outer cover.

Advantages of the Invention

The advantage of the vehicle-mounted antenna waterproof structure of the present invention is that the work to assemble manually the waterproof structure is not required and a mounting mistake can be prevented, and that the waterproof resin is tightly welded to the resin base. Another advantage is that, since the waterproof resin is tightly welded to the resin base, it is possible to prevent water, dust, and the like from getting into between the waterproof resin and the resin base.

BEST MODE FOR CARRYING OUT THE INVENTION

Figure 1A:
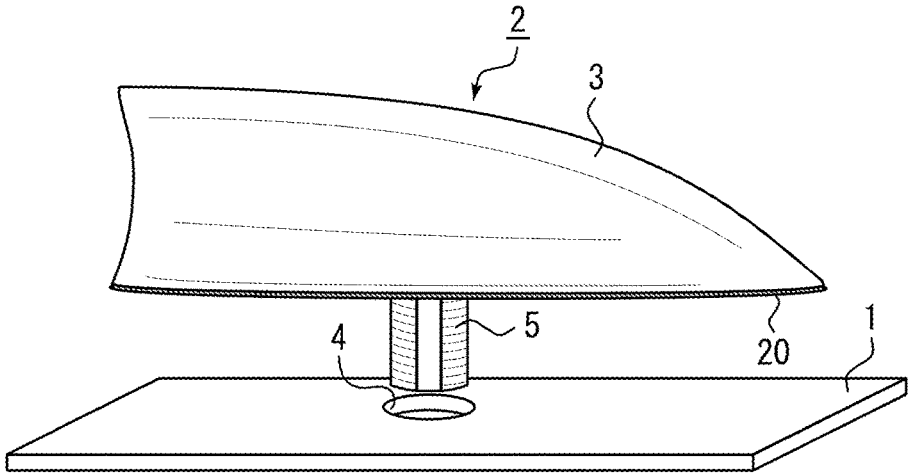
FIG. 1 is a schematic view for explaining a vehicle-mounted antenna waterproof structure according to the present invention.
Figure 1B:
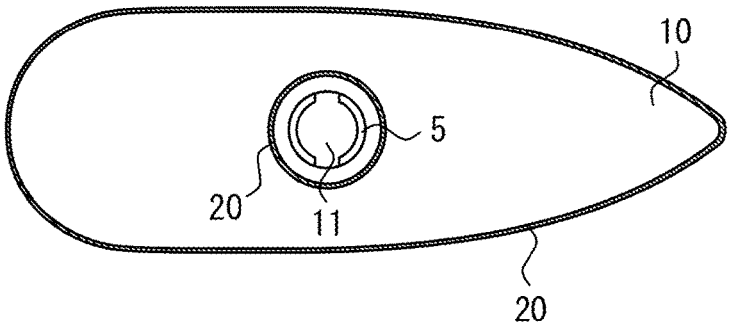

Hereinafter, embodiments of the present invention will be described together with examples shown in the accompanying drawings. FIG. 1 is a schematic view for explaining a vehicle-mounted antenna waterproof structure according to the present invention. FIG. 1A is a perspective view thereof, and FIG. 1B is a bottom view thereof. As shown in the diagram, a vehicle-mounted antenna waterproof structure of the present invention is applied to a vehicle-mounted antenna 2 that is mounted on an antenna mounting surface 1 of a vehicle body, such as a roof, a hood, or a trunk lid. The vehicle-mounted antenna waterproof structure mainly includes a resin base 10, which is made of resin, and a flexible antenna mounting-side waterproof resin portion 20.

The resin base 10 is made of resin and covered with an antenna cover 3. One surface of the antenna cover 3 faces the antenna mounting surface 1, and the other surface (region) defines the outer shape of the vehicle-mounted antenna 2. The resin base 10 is molded by a die, for example; on an upper surface thereof, screw holes, ribs, and the like are provided to allow an antenna element, an electrical circuit, and the like to be placed thereon. In order to enhance the strength of the resin base 10, reinforcing ribs or the like may be appropriately provided. The antenna cover 3 may be screwed onto the resin base 10, or be welded by ultrasonic welding or the like. The antenna cover 3 may be formed integrally, or may be divided into an inner cover and an outer cover. In the latter case, the inner cover may be fixed to the resin base 10, and the outer cover may be fixed with a hook or the like that is provided on the resin base 10, inner cover, or the like. The resin base 10 may be formed integrally with a structure for supporting an antenna, or any other structure. In the resin base 10, a hole portion 11 may be provided to secure conduction into the inside of the antenna cover 3. For example, in the hole portion 11, a screw boss 5 may be placed; the screw boss 5 is inserted into a mounting hole 4, which is provided in the antenna mounting surface 1, and is used to fix the vehicle-mounted antenna 2. Moreover, instead of the screw boss that protrudes toward the roof side as shown in the example of the diagram, a screw hole may be provided in the resin base; a bolt or the like that is inserted from the vehicle inner portion side of the mounting hole 4 is screwed into the screw hole. As means to introduce a cable via the hole portion 11, the cable may be directly inserted, or may be inserted via a connector or the like. The screw boss 5 may be insert-molded in the resin base 10, or may be inserted into and fixed in the hole portion 11. Furthermore, the screw boss 5 may be made of resin. In such a case, the screw boss 5 may be formed integrally with the resin base 10.

The antenna mounting-side waterproof resin portion 20 is flexible, and is welded to the resin base 10 and abuts on the antenna mounting surface 1. The antenna mounting-side waterproof resin portion 20 is placed between the antenna mounting surface 1 and the resin base 10 in such a way as to fill the gap, thereby preventing water, dust, and the like from getting into the vehicle via the mounting hole 4, which is provided in the antenna mounting surface 1. The antenna mounting-side waterproof resin portion 20 is made of synthetic resin such as elastomer, for example; the antenna mounting-side waterproof resin portion 20 is preferably made of thermoplastic elastomer. In order to mold the antenna mounting-side waterproof resin portion 20, a die is disposed at a predetermined position of the resin base 10; the heated and melted thermoplastic elastomer is injected into a cavity via a gate of the die. As a result, the surface of the resin base 10 is melted by the high-temperature thermoplastic elastomer, and the boundary faces of the thermoplastic elastomer and resin base 10 are welded together, and the antenna mounting-side waterproof resin portion 20 is molded as a result. Incidentally, as for the thermoplastic elastomer, which is material of the waterproof resin portion 20, and the material of the resin base 10, an appropriate combination of materials may be selected so that the waterproof resin portion 20 and the resin base 10 are tightly welded together.

The vehicle-mounted antenna waterproof structure of the present invention is configured as described above. Therefore, with the use of a die or the like, the waterproof resin portion can be accurately and tightly disposed at a desired position. Accordingly, work to manually assemble the waterproof structure is unnecessary, and a mounting mistake can be prevented. It is possible to ensure that the antenna is waterproof and dustproof.

In the example described above, as shown in FIG. 1B, the antenna mounting-side waterproof resin portion 20 is provided at both the peripheral portion of the resin base 10 and the peripheral portion of the hole portion 11, which is provided in the resin base 10. However, the present invention is not limited to this. All that is required is for the antenna mounting-side waterproof resin portion 20 to be provided at a position where the antenna mounting-side waterproof resin portion 20 can make the portion between the antenna mounting surface 1 and the resin base 10 waterproof. The number of antenna mounting-side waterproof resin portions 20, and the position and shape thereof are not limited to those in the example shown in the diagram. That is, the antenna mounting-side waterproof resin portion 20 may be provided only at the peripheral portion of the resin base 10 or at the peripheral portion of the hole portion 11.

Figure 2A:
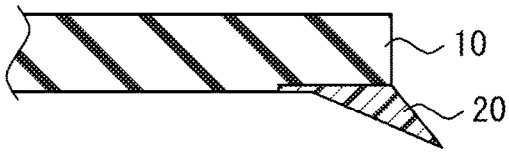
FIG. 2 is a partially enlarged sectional side view of a vehicle-mounted antenna waterproof structure of the present invention.
Figure 2B:
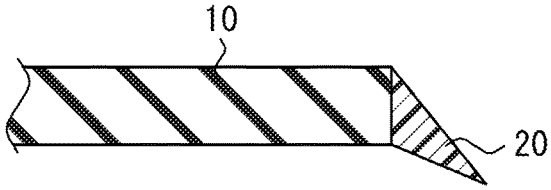

Hereinafter, the antenna mounting-side waterproof resin portion 20 will be described in more detail with the use of an enlarged view of the antenna mounting-side waterproof resin portion 20. FIG. 2 is a partially enlarged sectional side view of a vehicle-mounted antenna waterproof structure of the present invention. In the drawing, the same reference numerals as those in FIG. 1 denote the same parts as those in FIG. 1. The peripheral portion of the resin base 10 to which the antenna mounting-side waterproof resin portion 20 is welded may be an end portion of the resin base 10 that is closer to the antenna mounting surface 1 side, as shown in FIG. 2A, for example. As shown in FIG. 2B, the antenna mounting-side waterproof resin portion 20 may be provided on an end face of the resin base 10. In this manner, the peripheral portion of the resin base 10 is seamlessly and annularly surrounded by the antenna mounting-side waterproof resin portion 20. In this manner, the antenna mounting-side waterproof resin portion 20 can be disposed at a position where the antenna mounting-side waterproof resin portion 20 makes the portion between the resin base 10 and the antenna mounting surface 1 waterproof. The antenna mounting-side waterproof resin portion 20 preferably has an inclined shape that is inclined in a peripheral direction (radial direction) of the resin base 10, as shown in the diagram. Therefore, the antenna mounting-side waterproof resin portion 20 deforms when being pressed against the antenna mounting surface 1. As a result, the waterproof and dustproof properties can be secured with appropriate pressing force. Moreover, the peripheral portion of the resin base 10 to which the antenna mounting-side waterproof resin portion 20 is welded may be made slightly thinner in such a way as to provide a step as shown in the diagram, and the waterproof resin portion 20 may be poured into this portion so that the antenna mounting surface-side surface of the resin base 10 lies on the same plane as an inner side (or central side of the resin base 10) of the waterproof resin portion 20. In this case, the welding area becomes larger, making it even more unlikely for the antenna mounting-side waterproof resin portion to drop off the resin base 10.

Figure 2C:
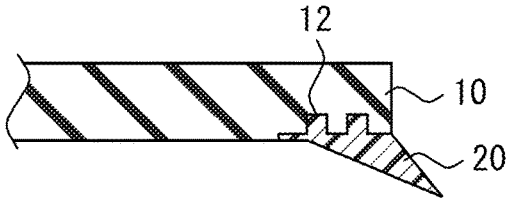

For example, as shown in FIG. 2C, at a position where the antenna mounting-side waterproof resin portion 20 is welded, an asperity portion 12 may be provided on the resin base 10 in order to increase the welding surface. As a result, the welding area becomes larger, and the antenna mounting-side waterproof resin portion 20 is more tightly fixed to the resin base 10.

The waterproof resin may be provided between the resin base 10 and the antenna cover 3. FIG. 3 is a partially enlarged sectional side view of a vehicle-mounted antenna waterproof structure in another example of the present invention. In the drawing, the same reference numerals as those in FIG. 1 denote the same parts as those in FIG. 1. In the example shown in FIG. 3A, in addition to the antenna mounting-side waterproof resin portion 20 that is provided on the antenna mounting surface side of the resin base 10, a waterproof resin portion is provided on the antenna cover 3 side of the resin base 10. That is, a flexible cover-side waterproof resin portion 21 is welded to a peripheral portion of a surface of the resin base 10 that is covered with the antenna cover 3. Incidentally, in the case of the vehicle-mounted antenna waterproof structure of the present invention, only the cover-side waterproof resin portion may be provided. The cover-side waterproof resin portion 21 is formed in such a way that the antenna cover 3 abuts on the cover-side waterproof resin portion 21. More specifically, a rib that is provided in an inner portion of the antenna cover 3 abuts on the cover-side waterproof resin portion 21. According to this configuration, when the antenna cover 3 is fixed to the resin base 10 with screws or the like, the rib that is provided on the antenna cover 3 digs into the cover-side waterproof resin portion 21. As a result, the waterproof and dustproof properties can be secured with appropriate pressing force. Incidentally, all that is required is for the cover-side waterproof resin portion 21 to be provided at a position where the antenna cover 3 abuts on the cover-side waterproof resin portion 21. Accordingly, the cover-side waterproof resin portion 21 may be positioned in such a way as to be held between the resin base 10 and the antenna cover 3.

Figure 3A:
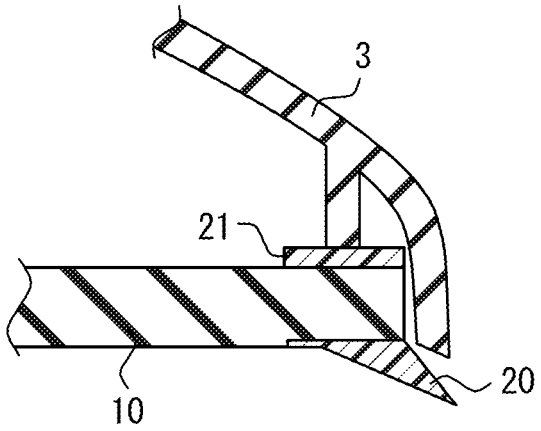
FIG. 3 is a partially enlarged sectional side view of a vehicle-mounted antenna waterproof structure in another example of the present invention.
Figure 3B:
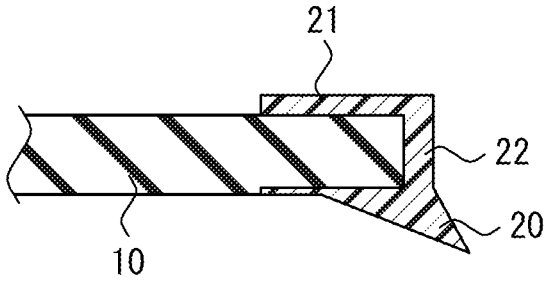

For example, as shown in FIG. 3B, the antenna mounting-side waterproof resin portion 20 and the cover-side waterproof resin portion 21 may be connected via a side resin portion 22, which is welded to a side surface of the resin base 10. As a result, the resin portions can be molded integrally, and therefore can be welded to the resin base 10 more tightly.

Figure 3C:
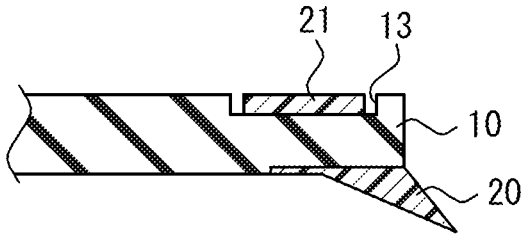

In the above-described example shown in the diagram, the cover-side waterproof resin portion 21 is just disposed on the surface of the resin base 10. However, the present invention is not limited to this. For example, as shown in FIG. 3C, a concave portion 13 may be provided on the surface of the resin base 10, and the cover-side waterproof resin portion 21 may be disposed inside the concave portion. In this case, if the width and thickness of the concave portion 13 are not sufficient, the cover-side waterproof resin portion 21 may fill the entire area of the concave portion 13. In such a case, the movement and deformation of the resin could be hampered at a time when the rib that is provided inside the antenna cover 3 abuts, and the antenna cover 3 might not dig sufficiently into the cover-side waterproof resin portion 21. Accordingly, the cover-side waterproof resin portion 21 may be disposed in such a way as to provide a predetermined clearance on one side or both sides in the concave portion 13.

Figure 3D:
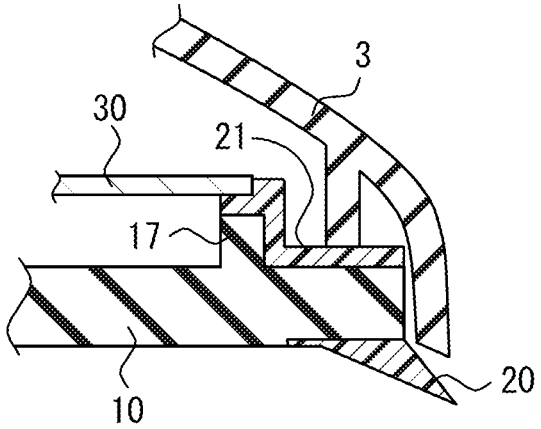

As shown in FIG. 3D, at a position that abuts on a vehicle-mounted antenna circuit board 30 that is disposed in an inner portion covered with the antenna cover 3, the cover-side waterproof resin portion 21 may be provided. That is, as shown in the diagram, the cover-side waterproof resin portion 21, which is provided at the position on which the rib that is provided inside the antenna cover 3 abuts, is also welded to a top surface of a pedestal 17 on which the circuit board 30 is placed. According to this configuration, a part of the cover-side waterproof resin portion 21 functions as a cushion for the circuit board 30, which is placed on the resin base 10. The circuit board 30 is separately fixed with screws, clips, or the like. Since there is the cover-side waterproof resin portion 21 between the circuit board 30 and the pedestal 17, the circuit board 30 does not shaky and is tightly fixed.

Figure 4A:
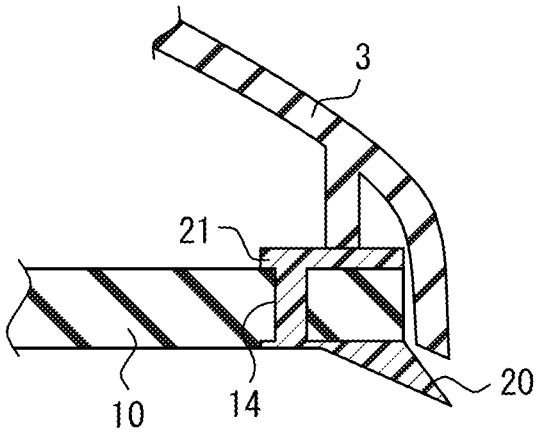
FIG. 4 is a partially enlarged sectional side view of a vehicle-mounted antenna waterproof structure in still another example of the present invention.

What will be described below is an example in which a waterproof resin portion is more tightly and evenly welded to the resin base. FIG. 4 is a partially enlarged sectional side view of a vehicle-mounted antenna waterproof structure in still another example of the present invention. FIG. 5 is a top view of a resin base that is used in the vehicle-mounted antenna waterproof structure in the example shown in FIG. 4. In the drawing, the same reference numerals as those in FIG. 1 denote the same parts as those in FIG. 1. In the example shown in FIG. 4A, tunnel portions 14 are provided, in addition to the example in which the antenna mounting-side waterproof resin portion 20 and the cover-side waterproof resin portion 21 are provided as shown in FIG. 3A. A plurality of tunnel portions 14 are provided in such a way as to pass through portions near where the cover-side waterproof resin portion 21 and the antenna mounting-side waterproof resin portion 20 are welded. Accordingly, the cover-side waterproof resin portion 21 and the antenna mounting-side waterproof resin portion 20 are connected together via the tunnel portions 14, and are integrally molded. The heated and melted thermoplastic elastomer, which will become the waterproof resin portions, is injected into a cavity via a gate of a die, and the boundary faces are welded together as the surface of the resin base 10 is melted. In this case, the tunnel portions 14 are provided. Therefore, the thermoplastic elastomer reaches the opposite side of the resin base 10 via the tunnel portions 14 as well. Accordingly, the thermoplastic elastomer reaches a welding surface before the temperature of the thermoplastic elastomer goes down, and the surface of the resin base 10 is more likely to be melted. As a result, the resin base 10 and the thermoplastic elastomer are more tightly welded.

Figure 4B:
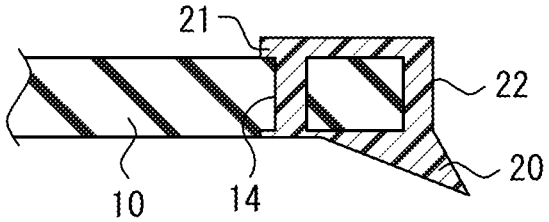
Figure 5:
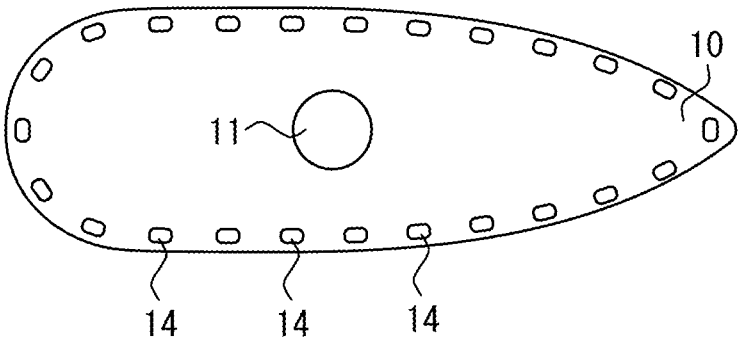
FIG. 5 is a top view of a resin base that is used in the vehicle-mounted antenna waterproof structure of the present invention in the example shown in FIG. 4.

In the example shown in FIG. 4B, tunnel portions 14 are provided, in addition to the example in which the antenna mounting-side waterproof resin portion 20, the cover-side waterproof resin portion 21, and the side resin portion 22 are provided as shown in FIG. 3B. In this example, the thermoplastic elastomer reaches the opposite side of the resin base 10 via the tunnel portions 14. The thermoplastic elastomer also reaches the opposite side by travelling along the side surface of the resin base 10. Therefore, during an even shorter period of time, the thermoplastic elastomer can flow to a predetermined welding surface. Accordingly, the thermoplastic elastomer reaches the welding surface before the temperature of the thermoplastic elastomer goes down, and the resin base 10 is more tightly and quickly welded. If there is no tunnel portion 14, the cover-side waterproof resin portion 21 is formed after the thermoplastic elastomer travels along and goes around the side of the resin base 10. In this case, however, a sufficient amount of thermoplastic elastomer may not reach the end. If the tunnel portions 14 are provided, it is possible to ensure that the thermoplastic elastomer reaches the end.

In the example in which the tunnel portions 14 are provided as shown in FIG. 4 or 5, as shown in FIG. 4, it is preferred that the tunnel portions 14 be disposed in such a way as to avoid the position on which the rib that is provided inside the antenna cover 3 abuts. If a tunnel portion 14 is provided at the position on which the rib of the antenna cover 3 abuts, the force that the antenna cover 3 exerts to press the cover-side waterproof resin portion 21 becomes uneven, possibly leading to a drop in the waterproof and dustproof performance. Therefore, as shown in the example of the diagram, the tunnel portion 14 is disposed away from the contact position. As a result, the antenna cover 3 evenly presses the cover-side waterproof resin portion 21, leading to an increase in the waterproof and dustproof performance.

Figure 6A:
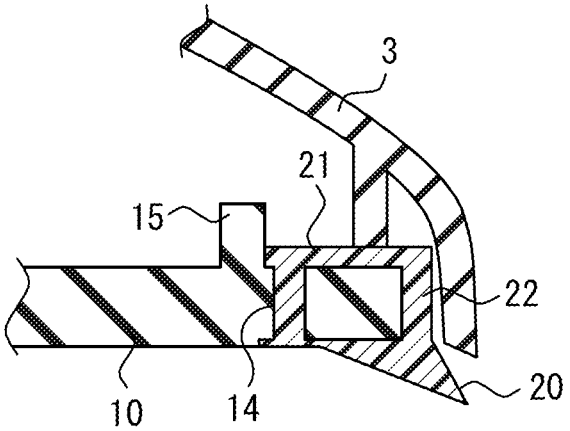
FIG. 6 is a schematic view for explaining an example in which a reinforcing rib is provided on a resin base in a vehicle-mounted antenna waterproof structure of the present invention.
Figure 6B:
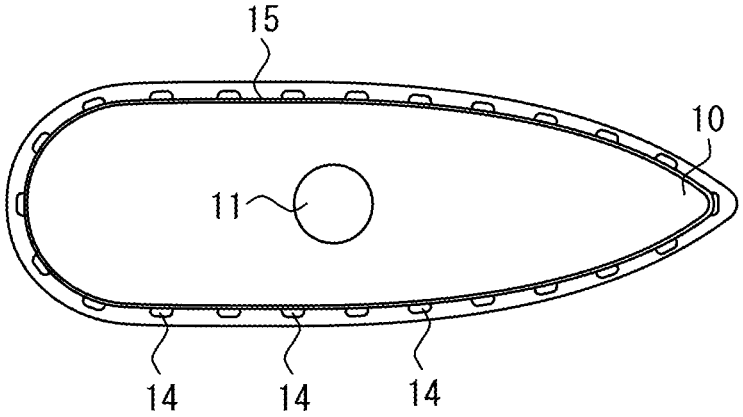

What will be described below is an example in which a reinforcing rib is provided on a resin base in the vehicle-mounted antenna waterproof structure of the present invention. FIG. 6 is a schematic view for explaining an example in which a reinforcing rib is provided on the resin base in the vehicle-mounted antenna waterproof structure of the present invention. FIG. 6A is a partially enlarged sectional side view thereof. FIG. 6B is a top view of the resin base that is used in the vehicle-mounted antenna waterproof structure. In the drawing, the same reference numerals as those in FIG. 1 denote the same parts as those in FIG. 1. As shown in the diagram, in this example, in order to boost the strength of the resin base 10, a reinforcing rib 15 is provided near a peripheral portion of the resin base 10. The reinforcing rib 15 is located near one side of the cover-side waterproof resin portion 21 and/or one side of the antenna mounting-side waterproof resin portion 20. The reinforcing rib 15 should be placed as close to the peripheral portion of the resin base 10 as possible in order to increase the strength of the resin base 10 and to ensure a wider space being covered with the antenna cover 3 and resin base 10. Furthermore, the welding area increases as the cover-side waterproof resin portion 21 abuts on the reinforcing rib 15, and the cover-side waterproof resin portion 21 is therefore more tightly fixed to the resin base 10. If reinforcing ribs 15 are disposed in such a way as to encircle, without any clearance, both sides of the cover-side waterproof resin portion 21 and/or both sides of the antenna mounting-side waterproof resin portion 20, the movement and deformation of the resin could be hampered at a time when the antenna cover 3 abuts, and the antenna cover 3 might not dig sufficiently into the cover-side waterproof resin portion 21. Accordingly, it is preferred that the reinforcing rib 15 be disposed near one side of the cover-side waterproof resin portion 21 and/or one side of the antenna mounting-side waterproof resin portion 20. Incidentally, if there is a gap between the reinforcing rib 15 and the cover-side waterproof resin portion 21 and the antenna mounting-side waterproof resin portion 20, the reinforcing ribs may be provided on both sides. The reinforcing rib may be used as a pedestal on which the above-described circuit board is placed.

Figure 7:
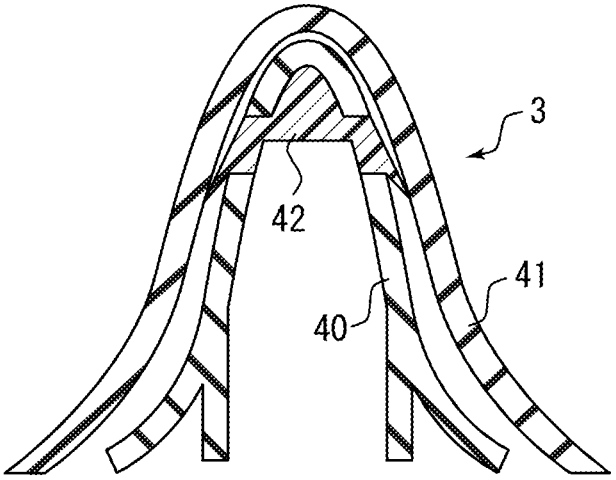
FIG. 7 is a schematic cross-sectional view for explaining an example in which the vehicle-mounted antenna waterproof structure of the present invention is applied to the antenna cover side.

What will be described below is an example in which the vehicle-mounted antenna waterproof structure of the present invention is applied to the antenna cover side. FIG. 7 is a schematic cross-sectional view for explaining an example in which the vehicle-mounted antenna waterproof structure of the present invention is applied to the antenna cover side. In this example, the antenna cover 3, which defines the outer shape of the vehicle-mounted antenna, has a double structure, including an inner cover 40 and an outer cover 41. The inner cover 40 covers the resin base 10. The outer cover 41 covers the inner cover 40. For example, the inner cover 40 is fixed to the resin base 10 by welding or the like. There are options for the outer cover 41, depending on the type of vehicle or the color of the body. In the case of the antenna cover 3 having such a configuration, a flexible inner cover-side waterproof resin portion 42 is welded to the inner cover 40. The inner cover-side waterproof resin portion 42 is provided in such a way as to abut on the outer cover 41. Incidentally, in the example shown in the diagram, the inner cover-side waterproof resin portion 42 is connected on the inner side of the inner cover 40. In the case of the vehicle-mounted antenna waterproof structure of the present invention, this configuration allows the outer cover to be fixed to the inner cover in a stable manner.

Incidentally, the vehicle-mounted antenna waterproof structure of the present invention is not limited to the above-described examples shown in the diagrams. Needless to say, various changes may be made without departing from the spirit of the present invention. The above-described examples shown in the diagrams may be appropriately used in combination. For example, even in the examples shown in FIGS. 3, 4, and 6 and other diagrams, an asperity portion 12 may be provided on the resin base 10 as shown in FIG. 2C in order to increase the welding surface.

EXPLANATION OF REFERENCE SYMBOLS

1: Antenna mounting surface
2: Vehicle-mounted antenna
3: Antenna cover
4: Mounting hole
5: Screw boss
10: Resin base
11: Hole portion
12: Asperity portion
13: Concave portion
14: Tunnel portion
15: Reinforcing rib
17: Pedestal
20: Antenna mounting-side waterproof resin portion
21: Cover-side waterproof resin portion
22: Side resin portion
30: Circuit board
40: Inner cover
41: Outer cover
42: Inner cover-side waterproof resin portion

The invention claimed is:

1. A waterproof structure that is applied to a vehicle-mounted antenna mounted on an antenna mounting surface, the vehicle-mounted antenna waterproof structure comprising:

a resin base that is made of resin and whose one surface faces the antenna mounting surface while the other surface is covered with an antenna cover that defines an outer shape of the vehicle-mounted antenna;

an antenna mounting-side waterproof resin portion having flexibility that is welded to the resin base and abuts on the antenna mounting surface; and a cover-side waterproof resin portion having flexibility that is welded to a surface of the resin base covered with the antenna cover and on which the antenna cover abuts, wherein the resin base further comprises a plurality of tunnel portions that pass through portions near where the cover-side waterproof resin portion and the antenna mounting-side waterproof resin portion are welded; and the cover-side waterproof resin portion and the antenna mounting-side waterproof resin portion are connected via the tunnel portions, the plurality of tunnel portions are perpendicularly extended to the surface of the resin base, and the resin base is sandwiched between the antenna mounting-side waterproof resin portion and the cover-side waterproof resin portion.

2. A waterproof structure that is applied to a vehicle-mounted antenna mounted on an antenna mounting surface, the vehicle-mounted antenna waterproof structure comprising:

a resin base that is made of resin and includes a hole portion to secure conduction into an inside of an antenna cover and whose one surface faces the antenna mounting surface while the other surface is covered with the antenna cover that defines an outer shape of the vehicle-mounted antenna;

an antenna mounting-side waterproof resin portion having flexibility that is welded to a peripheral portion of the hole portion of the resin base and abuts on the antenna mounting surface; and a cover-side waterproof resin portion having flexibility that is welded to a surface of the resin base covered with the antenna cover and on which the antenna cover abuts, wherein the resin base further comprises a plurality of tunnel portions that pass through portions near where the cover-side waterproof resin portion and the antenna mounting-side waterproof resin portion are welded; and the cover-side waterproof resin portion and the antenna mounting-side waterproof resin portion are connected via the tunnel portions, the plurality of tunnel portions are perpendicularly extended to the surface of the resin base, and the resin base is sandwiched between the antenna mounting-side waterproof resin portion and the cover-side waterproof resin portion.

3. The vehicle-mounted antenna waterproof structure according to claim 1, in which the tunnel portions are disposed in such a way as to avoid a position on which the antenna cover abuts.

* * * * *